United States Patent [19]

Baugh

[11] 3,978,587

[45] Sept. 7, 1976

[54] DRAFTING SYSTEM AND APPARATUS

[76] Inventor: Hilton Baugh, 8575 Glen Ellen Drive, Arvada, Colo. 80002

[22] Filed: Oct. 29, 1974

[21] Appl. No.: 518,256

[52] U.S. Cl. ..... 33/77; 33/107 R; 33/80

[51] Int. Cl.[2] ..... B43L 13/14

[58] Field of Search ..... 33/77, 99–100, 33/107, 27 C, 80

[56] References Cited

UNITED STATES PATENTS

| | | | |
|---|---|---|---|
| 1,189,849 | 7/1916 | McKenney | 85/16 X |
| 1,248,148 | 11/1917 | Milliken | 33/27 C |
| 2,026,768 | 1/1936 | Aronson | 33/27 C |
| 2,526,528 | 10/1950 | Zickler et al. | 33/191 |
| 2,981,004 | 4/1961 | Edlund | 33/77 |
| 3,381,551 | 5/1968 | Lavering et al. | 33/191 |

FOREIGN PATENTS OR APPLICATIONS

| | | | |
|---|---|---|---|
| 474,890 | 7/1951 | Canada | 33/107 R |
| 577,288 | 2/1924 | France | 33/107 R |
| 590,101 | 3/1925 | France | 33/107 R |
| 302,299 | 12/1917 | Germany | 33/77 |
| 254,831 | 1/1949 | Switzerland | 33/112 |

OTHER PUBLICATIONS

American Machinist/Metalworking Mfg. 9/30/63 p. 77.

*Primary Examiner*—Harry N. Haroian
*Attorney, Agent, or Firm*—Ancel W. Lewis, Jr.

[57] ABSTRACT

In a drafting system for drawing perspective views and the like, a ruling blade has a reference head extending laterally beyond at least one ruling edge formed with one or more pin-receiving holes arranged in line with the ruling edge adapted to receive a pivot pin removably anchored at a selected point on the drawing surface, typically the vanishing point, for edge pivoting of the ruling blade to draw perspective lines on a sheet from a remote point up to the vanishing point and the like. One form of the ruling blade has a center groove in at least one side and preferably in both sides with opposed inside wall surfaces along its length together with a separate cap-like reference head releasably attached to the blade carrying a locking cam selectively moved into engagement with one of the inside wall surfaces to releasably lock the reference head at any position along the grooved ruling blade. In a unitary ruling blade for shorter lines, the reference head is made integral with the blade. A pair of the grooved ruling blades are releasably connected end to end by a slide-on clamp for making longer lines. Another form of reference head is generally shaped in the form of a T-square head which is used in pairs at opposed positions on a grooved ruling blade or connected blades and each T-square reference head is provided with pin-receiving holes at spaced intervals along its length so that one pin on the board positions the blade horizontally and at a selected vertical distance from the vanishing points for drawing vertical lines using a triangle supported on the ruling blade. When a T-square reference head is locked on one end of the grooved ruling blade in a second position the assembly is suitable for use as a T-square.

13 Claims, 18 Drawing Figures

HL
LVP
RVP

DRAFTING SYSTEM AND APPARATUS

FIELD

This invention relates to drafting apparatus and more particularly to a novel and improved drafting system and apparatus suitable for drawing perspective views and the like.

BACKGROUND

There is a continuing effort by draftsmen to improve drafting instruments and techniques to minimize effort in thinking and physical manipulation and to minimize the number and complexity of instruments present on drawing boards for the usual drafting requirements. One common drawing or illustration for which the present invention is particularly suitable is in the drawing of a perspective view.

In constructing a perspective drawing, it is desirable to know the exact location of a vanishing point and be able to return to the vanishing point with a minimum of time and effort each time the ruling blade is moved. In cases where a remote vanishing point is required, the presently used methods of drawing involve the use of perspective charts. These charts in effect only estimate the location of a vanishing point. Their usefulness is limited both dimensionally and by the relatively few angle situations they cover and by their printed lines, which whenever bowed in the printing process, adds another element to cause inaccuracy. Moreover, with perspective charts there is the necessity of using tracing paper and this requires retracing for comprehensive drawing.

It is also desirable to produce a dense black waterproof line that will hold a good reproduction quality after it is erased over and washed over. A dense black waterproof line imposes the use of a higher density ink which because of its viscosity, flows and dries more slowly. This in turn limits its use to select applicator tools. Also a more viscous paint when used to rule a line produces a higher bead on the surface of the paper. These characteristics combine to increase the chances of ink contact between the drawing paper and ruling blade. When a ruling blade contacts a wet bead, the blade will act as an uncontrolled vehicle for escorting ink to unpredictable areas in drawing. This situation is aggravated by the uneven or wavy surface of some types of drawing paper. Time is also an important factor in using dense inks or paint. A slight amount of drying by evaporation exercises too great an influence over higher viscosity ink and this must be overcome by keeping the ink flowing from the applicator tool.

In presently used methods of drawing from a vanishing point, two hands are needed to maneuver the ruling blade into alinement, after which one hand is used to rule and the other hand is used to both stabilize the blade in the sight area and hold to the vanishing point. In the case of a distant vanishing point, the leverage problem becomes acute. To avoid ink or paint contact with the ruling blade, blotters must be repositioned under the blade each time it is moved, unless enough tape is added to the blade to set it away from the surface of the drawing. The time required in these maneuvers is usually enough to allow the ink in the applicator to dry (just enough to prevent ink flow) in which case the tool must be cleaned, new ink added and part of the maneuver repeated. It is this feature which discourages the use of ink that has the best reproduction quality.

It is therefore a desirable accomplishment to be able to rule from a vanishing point in a way that ensures accuracy, that vanishing point must be anchored within the confines of a stable drawing plane or table surface. (Off the table apparatus made of steel rod is subject to deflection at the vanishing points.) Contact between a ruling blade and the drawing paper must be minimized at the ruling edge of the blade and maximized at a safe distance from the ruling edge.

Because large drawing tables are available and simple detachable extensions can be constructed for smaller tables, it is desirable to provide some type of apparatus that will improve existing drafting practices within the limits of a table surface.

Accordingly, it is a general object of this invention to provide a novel and improved drafting system and apparatus.

Another object of this invention is to provide a simple, durable, versatile, efficient and comparatively inexpensive drafting system and apparatus that is particularly effective in returning to vanishing point in a perspective drawing and ruling all lines on a drawing.

Another object of this invention is to provide a drafting system in which a selected point such as the vanishing point in a perspective drawing may be anchored within the confines of a drawing plane or table surface to insure drawing accuracy.

Still another object of this invention is to provide a novel ruling blade characterized by a minimum contact between the ruling edge and the drawing paper and maximized a safe distance from the ruling edge.

Still a further object of this invention is to provide a drafting system that is usable on smaller drafting tables and larger drawing tables with detachable extensions in such a way that it allows a conformable angle to the drawing surface, occupies only the table area needed to reach the vanishing points with accuracy and does not impose added inconveniencies over existing practices.

Yet another object of this invention is to provide a drafting system that allows:

a. reaching and anchoring to vanishing points that are considered remote but within the confines of a drafting surface;

b. a steeper, more comfortable working angle to the drawing surface;

c. returning to and ruling from vanishing points in a way that is not subject to ruling deflection in the sight area or binding at the vanishing points;

d. keeping the drawing area relatively free from friction surface, smudge producing and sight interferring apparatus in excess of that is needed for a particular line or lines in a drawing;

e. ruling with a wide range of scribing instruments, inks and paints.

Another object of this invention is to provide improved drafting system that minimizes the amount of apparatus on a board, minimizes physical manipulation and is particularly effective in accurately drawing perspective views.

Still another object of this invention is to provide novel drafting apparatus having an edge pivoted ruling blade that allows the drawing of a perspective line to the vanishing point.

Another object of this invention is to provide novel drafting apparatus and system characterized by the provision of an upright pivot pin at a selected point on a drawing board such as at a vanishing point and a ruling blade having a ruling edge and a pin hole or slot receiving the pin whereby the ruling blade is edge pivoted.

Still another object of the present invention is to provide a drafting system in which a pair of T-square like reference heads are removably attached to a grooved ruling blade and referenced to the vanishing points to draw vertical lines and wherein the T-square like heads and blades also provide a T-square function.

Other objects, advantages and capabilities of the present invention will become more apparent as the description proceeds taken in conjunction with the accompanying drawings, in which.

Figure 1:
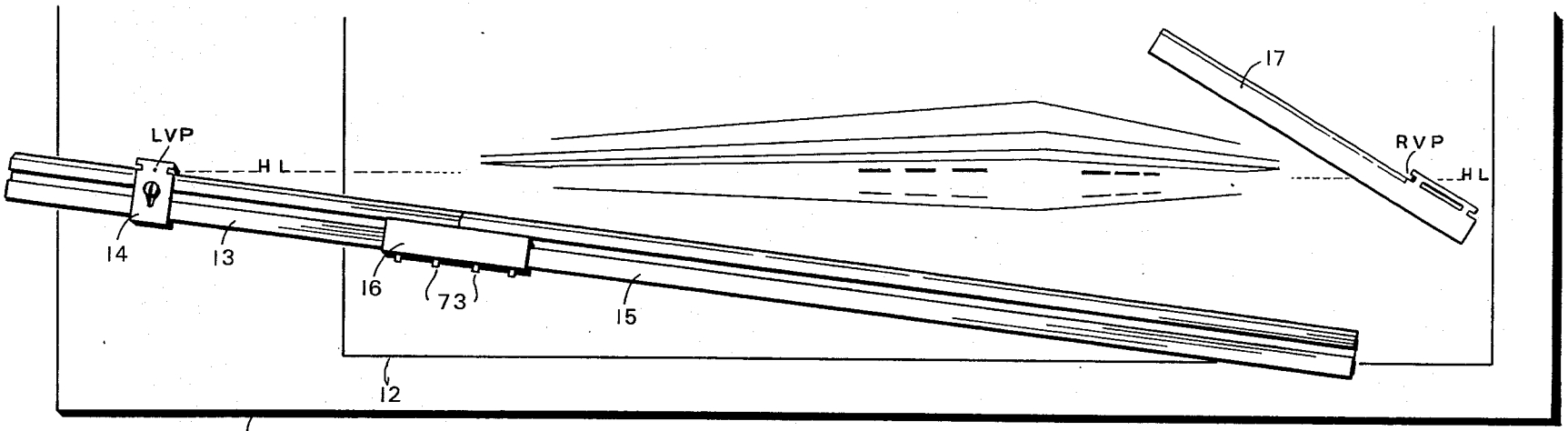
FIG. 1 is a top perspective view of a portion of a drafting system embodying features of the present invention.
Figure 2:
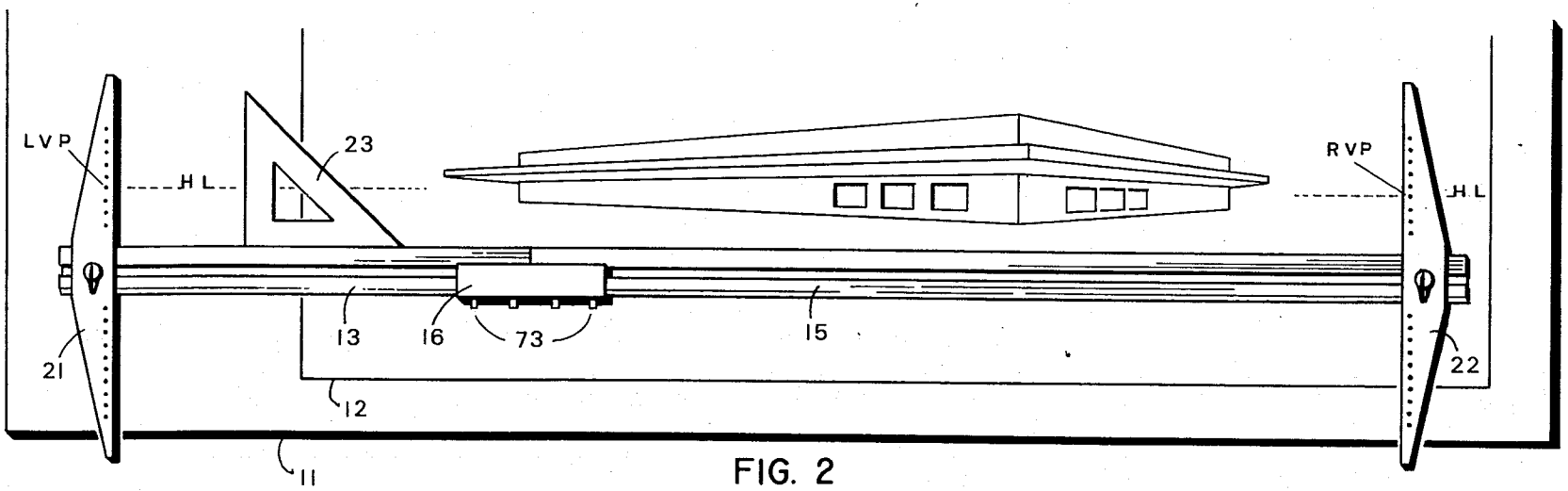
FIG. 2 is a top perspective view of another portion of the drafting system embodying features of the present invention.

Referring now to FIGS. 1 and 2, there is shown a drawing board 11 having a drawing sheet 12 thereon together with a grooved ruling blade 13 with a removable cap-like reference head 14 mounted on blade 13 pivotally supported at a left vanishing point designated LVP located on a horizon line designated HL. The left vanishing point is shown on the drawing board to the left of the drawing sheet. Ruling blade 13 has a longer grooved ruling blade 15 similar in cross-section to ruling blade 13 coupled by a coupling device 16 end to end to blade 13 for drawing perspective lines running toward and away from the left vanishing point. There is further shown a unitary ruling blade 17 pivotally supported at the right vanishing point on the horizon line designated RVP. In FIG. 2 there is shown on the same drawing board 11 the end connected grooved ruling blades 13 and 15 carrying a pair of removable T-square reference heads 21 and 22 at opposite positions and referenced to the left and right side vanishing points, respectively, to position the blades horizontally to support a conventional right angle triangle 23 for the drawing of vertical lines in the illustration on the drawing sheet.

Figures 3, 4, 5, 6, 7, 8, 9, 10, 11:
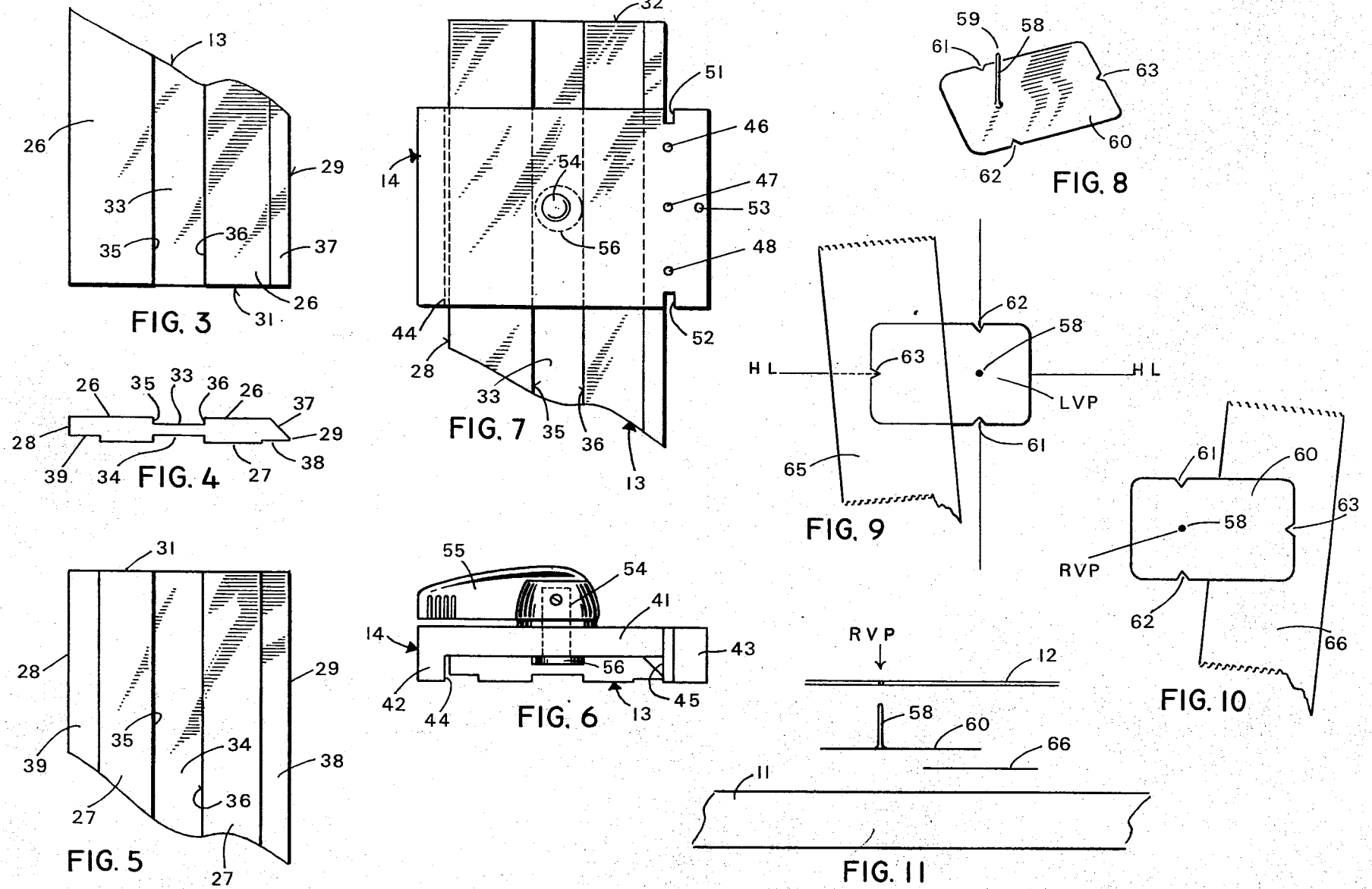
FIG. 3 is a top plan view of an end portion of the grooved ruling blade shown in FIGS. 1 and 2.
FIG. 4 is an end view of the ruling blade of FIG. 3.
FIG. 5 is a bottom plan view of the ruling blade of FIGS. 3 and 4.
FIG. 6 is an end elevation view of the combined cap-like reference head and ruling blade as shown in operation in FIG. 1.
FIG. 7 is a top plan view of the head and blade combination of FIG. 6 with the knob removed to show the position of the locking cam.
FIG. 8 is a perspective view of a pivot pin assembly.
FIG. 9 is a top plan view of a pivot pin assembly shown in FIG. 8 and illustrated as it is mounted on the drawing board surface at the left vanishing point of the drawing of FIGS. 1 and 2.
FIG. 10 is a top plan view of a pivot pin assembly of FIG. 8 and illustrated as it is mounted at the right vanishing point of the drawing of FIGS. 1 and 2.
FIG. 11 is an exploded side elevation view of the relationship of the drafting paper, pivot pin assembly, tape and drawing board as it is arranged in FIGS. 1 and 2.

Referring now to FIGS. 3, 4 and 5, there is shown in more detail the grooved ruling blade 13. This blade is in the form of a thin, flat member having a pair of oppositely disposed flat side faces 26 and 27, a pair of oppositely disposed ruling edges 28 and 29 and a pair of oppositely disposed straight end edges 31 and 32. A center groove 33 is formed in side 26 and a center groove 34 is formed in side 27. Each of these center grooves extend the full length of the blade and each provide a pair of opposed grained inside wall surfaces designated 35 and 36. Side 26 has a beveled surface 37 terminating at ruling edge 29 making ruling edge 29 a relatively thin edge in comparison to the opposite edge 28. Finally, face 27 has a lateral recess 38 extending inwardly from edge 29 and a lateral recess 39 extending inwardly from edge 28. Recesses 38 and 39 set ruling edges 28 and 29, respectively, away from the surface of the drawing. The side faces 26 and 27 are flat and smooth to maximize contact with the drawing and smooth out the wavy surface characteristic of lightweight paper and in particular with ink receptive tracing paper. The combination of recessed areas 38 and 39 and flat surface 27 work together to minimize the chances of contact between the blade and any ink or paint applied to the drawing with a ruling pen.

As noted above, the beveled surface 37 in side 26 is beveled to provide a comparatively thin edge at 29. The height from the drawing surface to the top of this edge is within that limit necessary for the efficient use of the new technical fountain pens. (These instruments have a shoulder on the tip a short distance above the point.) This height is enough to allow tilting an ink scribing tool to the exact angle needed to pick up and continue a line and to rule two hair lines close together without moving the blade. When the ruling blade assembly is reversed or turned over to rest on side 26 then edge 28 becomes the working edge of the blade. This feature is useful when it becomes necessary to scribe along the corner at ruling edge 28 and recess 39 with a knife (such as in the construction of a knockout or an overlay to a drawing). Using a knife to scribe along edge 29 would possibly nick this edge which is designed for fine ruling. The side 26 has more tracking surface to guide a knife so there is less possibility of tilting the knife in such a way as to cut the edge.

Figures 12, 13, 14, 15, 16, 17, 18:
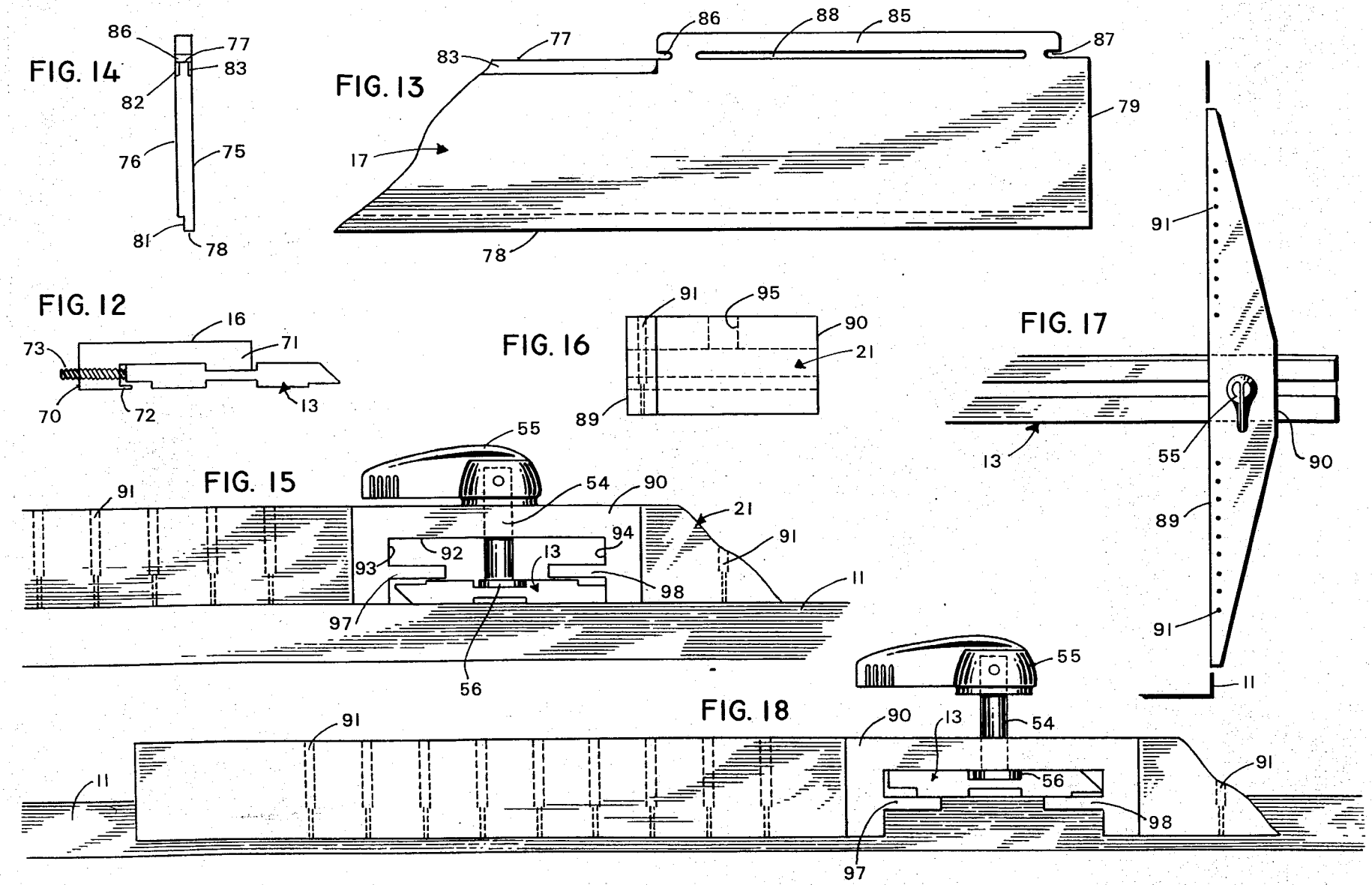
FIG. 12 is an end elevation view showing the coupling for the connected grooved butting blades of FIGS. 1 and 2.
FIG. 13 is a top plan view of a portion of the unitary ruling blade of FIG. 1.
FIG. 14 is an end view of FIG. 13 as viewed from the broken end.
FIG. 15 is an end elevation view of the combined blade and T-square reference head shown in FIG. 2.
FIG. 16 is an end elevation view of the T-square reference head with the cam, shaft and knob removed.
FIG. 17 is a top plan view of the ruling blade and T-square reference head used as a T-square on the drawing board.
FIG. 18 is an end elevation view of FIG. 17 looking from the outside toward the end of the board and T-square reference head and ruling blade.

The depth of recess 39 is greater than recess 38. Using side 26 as the working side and edge 28 as the working edge the blade is more useful when a heavy bead of paint must be applied with a large ruling pen. The corner at side 26 and edge 28 is a right angle to accomodate any situation where an edge that is flush with the drawing surface is needed.

Where vanishing points that are beyond sight or reach, are too distant for one blade, two blades 13 and 15 are locked together end to end by means of the coupling 16 which slides on either end of the blades and is fastened by turning set screws 73. The coupling 16 for joining two blades end to end is arranged so that all three of the working or ruling edges are available for use as is shown in FIG. 12. When two blades must be joined together to reach a vanishing point, the side face 28 functions as a clamping surface for the set screws 73, which in turn seat the inside wall surfaces 35 and the edges 29 of two blades into alinement as best seen in FIG. 12.

Referring now to FIGS. 6 and 7, the reference head 14 is shown to be in the form of an oblong cap like member having an intermediate portion 41 and a pair of depending side portions 42 and 43 that extend beyond the ruling edges of the ruling blade 13 and form a channel sized to slidably receive the ruling blade 13. Side portions 42 and 43 have a pair of opposed inside guide surfaces 44 and 45, respectively, that move along and in slidable engagement with the ruling edges of the blade. The reference head 14 further has three pin receiving holes 46, 47 and 48 and a pair of opposed notches 51 and 52 arranged along a line in the blade of guide face 45. A pin receiving hole 53 is arranged laterally outwardly of hole 47 and parallel to said three holes and a pair of notches 51 and 52 along the ruling blade edge. The reference head 14 carries a releasable locking arrangement for locking it to the blade 13 in the form of a shaft 54 centered in a hole in the intermediate portion 41 having a removable knob 55 with the upper end and an eccentric cam 56 at the lower end shown positioned inside channel 33. Upon rotation of the shaft the cam moves into frictional engagement with one of the inside wall faces 35 or 36 to lock the reference head 14 to the ruling blade 13.

As generally illustrated in FIGS. 1 and 2, the combined ruling blade and reference head illustrated in more detail in FIGS. 6 and 7 is edge pivoted in a selected one of the pin-receiving slots or holes above described. The pivot point is established by means of a demountable pivot pin assembly illustrated in FIG. 8 which comprises an upright pin 58 terminating in a dull top point 59 supported upright on a thin flat base 60. The base further has a pair of opposed notches 61 and 62 in line with the pin in opposite edges and a third notch 63 with right angles to the opposed notches in line with the pin. As further illustrated in FIG. 9 and with reference to the left vanishing point LVP illustrated in FIGS. 1 and 2 the base is attached directly to the drawing board with a strip of tape designated 65 and alined so that notch 63 and the pin are in line with a horizon line HL shown and the opposed notches 61 and 62 line up with a vertical line shown. At the right vanishing point RVP there is shown in FIGS. 10 and 11 the pivot pin assembly wherein the base is secured to the underside of the drawing sheet designated 12 by a strip of tape 66. This locates the pivot pin at the vanishing points and they are maintained there until the perspective drawing is complete.

Referring now to FIG. 12, the coupling 16 is shown to have a recess provided by a pair of opposed depending portions 70 and 71 and a lower inturned portion 72 into which the blade 13 is inserted. A plurality of set screws 73 at spaced intervals along the coupling are used to lock the coupling of the ruling blades.

The pin-receiving hole 53 is positioned as close to the adjacent outer face as possible. This hole may be used to position the blade relative to the vanishing points by using a pair of the reference heads, one at each vanishing point much like the T-square heads are used as described hereinafter but would be used only for smaller drawings.

The unitary ruling blade 17 shown in more detail in FIGS. 13 and 14 has a pair of side faces 75 and 76, a pair of oppositely disposed ruling edges 77 and 78 and a pair of oppositely disposed end edges with the one end edge shown in FIG. 13 designated 79. Side face 76 is recessed at 81 at ruling edge 78 and the other side edge is recessed on both sides at 82 and 83. Blade 17 is made with an integral reference head 85 that projects beyond the side edge 77 adjacent end 79. The head is formed with a pair of pin-receiving slots 86 and 87 in opposite ends thereof and an elongated intermediate pin-receiving slot 88 between the ends thereof.

The unitary ruling blade 17 employs the same principles as the removable reference head 14 and grooved ruling blade 13 above described. Illustrating this particular unitary ruling blade is not intended to restrict the location of the shoulder or the number of shoulders, the position and dimension of the edges or the overall dimension of the blade. Unitary ruling blades are designed to meet the individual requirements of a wide range of drafting conditions. Such conditions are usually dictated by the type of work the artist or draftsman is most accustomed to doing. Generally, these unitary ruling blades will be used in constructing smaller drawings where the vanishing points are closer together and a longer blade is not needed. A small drawing can be constructed with more efficiency of movement, by selecting an appropriate single integral blade or a combination of single integral blades. Slot 86 is used to rule all the way to the vanishing point. Slot 88 is normally used to shift the blade on the vanishing point pin by that amount needed to swing clear of the opposite vanishing point pin. Slot 87 is normally used to extend the reach of the blade from the vanishing point. A single unitary blade can be conveniently moved between vanishing point pins. Recess 81 is recessed by the same amount as recess 39 in FIG. 4. Recesses 82 and 83 are the same amount as recess 38 in FIG. 4. The unitary blade can be used and switched between vanishing point pins by selecting a unit where the edge 77 is shorter by the length of the length of the head 85 than the distance between vanishing points. Such a blade will be short enough to miss the opposite vanishing point pin. Where drawing requirements are not as demanding, a selected unitary ruling blade can be positioned at each vanishing point and manipulated via the slot 88 to swing free of each other. On tables with a comfortable incline the blades remain anchored and action ready. The small hole left by the vanishing point pin 58 can be burnished back into the drawing paper, eliminating the necessity of cleaning up pencil damaged areas.

Each of the T-square reference heads shown in FIG. 2 are of an identical construction so that a description of one applies to both. Referring now to FIG. 15, the attachment of each head is shown and described with reference to head 21 mounted on blade 13. The head 21 is in the form of an elongated member having a pair of parallel spaced straight faces 89 and 90 and the member is symmetrical about a lateral line through the geometric center thereof. The reference head 21 has similarly shaped equally spaced pin-receiving holes 91 on each side of the center. The head has a central portion with a center recess 92 sized to receive the ruling blade and provide a pair of opposed inside faces 93 and 94. The inside faces are partitioned by a pair of inturned support portions 97 and 98 on faces 93 and 94, respectively, that serve to position the blade 13 in a close slide fitting relation in the recess 92 when only one T-square head is employed as shown in FIG. 18 and in a lower position flush with the support surface as shown in FIG. 15. The support portions 97 and 98 extend the full length of the blade. The central portion of the head has a hole 95 that receives the shaft 54, knob 55 and cam 56 identical to that of the earlier described reference head 14 to releasably lock head 21 to the blade in a similar manner. Head 21 is shown locked in a lower flush position below portions 97 and 98 in FIG. 15 for the use as shown in FIG. 2 and the lower side of the blade is locked flush with the bottom of head 21. In a long reach from the edge of a drawing board, a T-square is subject to deflection both along the extremity of the blade and at the T-square head (which must be maintained flush against the drawing board). Therefore, when the T-square heads are referenced from the vanishing points as illustrated in FIG. 2, it becomes a more stable method of providing a base for triangles. When alternately drawing horizontal and vertical lines, the T-square reference head can be adjusted for blade length and readily rotated to present the two most commonly used edges namely 29 for ruling horizontal lines and edge 28 as a solid base for a triangle to rule verticals. The inturned support portions 97 and 98 hold the T-square head from falling off the ruling blade if accidentally unlocked. This also accounts for the relative location of edge 28 and 29 of the ruling blade of FIG. 4.

When used as a T-square as shown in FIGS. 17 and 18, the top side of the blade engages the bottom of the recess so that the inside straight face 89 forms an edge that abutts against the side edge of the drawing board as is the practice with a conventional T-square. In a typical system using a 60 inch drawing table the ruling blade 13 will be 18 inches long and ruling blade 15 will be 36 inches long. The ability to couple the blades end to end and attach a T-square reference head to opposite ends as shown in FIG. 2 affords greater length for performing the drawing of vertical lines.

In a full sequence of operation for the above described system and apparatus, the horizon line HL, left vanishing point LVP on the drawing surface 11 and right vanishing point RVP on the drawing sheet 12 are located for a particular object being drawn in a conventional manner. A hole is punched through the drawing sheet at the right vanishing point RVP using any sharp, pointed instrument such as a sharp pin or round engraver's stylus or in the alternative the point of the pin 58 may be used. The pin 58 is then inserted in the hole from the underside of the drawing sheet and taped to the back of the drawing sheet as best illustrated in FIGS. 10 and 11 at the notch 63 which is located outside the horizon line. The left vanishing point LVP a pivot pin assembly is taped to the surface of the drawing board as illustrated in FIG. 9. Notch 63 is registered with that portion of the horizon line outside the left vanishing point LVP notches 61 and 62 are registered to a line perpendicular to and bisecting the horizon line at the left vanishing point LVP as shown in FIG. 9. The cap-like reference head 14 shown in FIGS. 6 and 7 is locked in place on ruling blade 13 and the reference head is placed over the pin at the left vanishing point using a selected of the pin receiving holes 46 through 48 or slots 51 and 52. The use of slot 52 allows a ruling all the way up to the left vanishing point LVP. The reference head is unlocked by twisting the knob and the ruling blade is then shifted relative to the reference head to a position where it will reach all construction lines leading to the vanishing point and will swing clear of the right vanishing point. The unitary ruling blade 17 is positioned at the right vanishing point with the pin being inserted into a selected of one of the end slots of center groove. When it is desired to draw the vertical lines to T-square head 21 and 22 connecting to the blade and referenced relative to the vanishing points by inserting the pivot pins into selected holes in the heads and positioning the T-square on the horizontal blade. Finally, by the removal of one of the heads the apparatus can be used as a conventional T-square.

From the foregoing it is apparent that the net result in using the system of the present invention is a substantial reduction in the most time consuming aspect of perspective drawing, namely searching for and securing to a vanishing point and safely ruling the lines.

Although the present invention has been described with a certain degree of particularity, it is understood that the present disclosure has been made by way of example and that changes in details of structure may be made without departing from the spirit thereof.

What is claimed is:

1. A ruling blade for drawing perspective views and the like comprising:

a thin, flat, elongated body having a pair of oppositely disposed supporting flat side faces arranged parallel to one another and reversible with either side face up, a pair of oppositely disposed parallel ruling edges, a pair of oppositely disposed parallel end edges, a channel-shaped center groove in each of said side faces extending the full length thereof providing a pair of opposed inside flat wall surfaces parallel to one another, one of said side faces having a beveled surface terminating at a ruling edge, the other of said side faces having a lateral recess extending laterally inwardly from each of said ruling edges, the lateral recess adjacent the beveled edge having less depth than the lateral recess adjacent the ruling edge opposite the beveled edge.

2. A ruling blade as set forth in claim 1 further including a reference head extending beyond one of said ruling edges having at least one pin-receiving hole arranged to position a pivot pin for pivoting the ruling blade relative to one ruling edge on a drawing board surface.

3. A ruling blade comprising a thin, flat, elongated body having a pair of oppositely disposed flat sides, a pair of oppositely disposed parallel ruling edges extending along the body and a pair of oppositely disposed end edges at the ends of said body, a center groove in at least one of said sides, and a removable reference head detachably mounted on said blade body, said reference head having a top portion and a pair of depending side portions forming a channel sized to receive said body, said side portions having inside guide faces for guiding movement of said reference head along said ruling edges of the blade body, one of said side portions extending laterally beyond one of said ruling edges and having at least one pin-receiving hole arranged to position said blade body on a drawing board surface, said reference head having locking means releasably locking said head to said body including a shaft having an eccentric cam disposed within said center groove, said cam being positioned to move against either of a pair of inside faces forming the sides of said center groove to wedge a ruling edge against the adjacent guide faces of said reference head.

4. A ruling blade as set forth in claim 3 wherein said removable reference head has spaced pin-receiving holes in one of said side portions and notches in opposed side edges of said one side portion, said holes and notches being arranged to position a reference surface of a pivot pin in line with one of the guide surface faces.

5. A ruling blade as set forth in claim 3 wherein said removable reference head is generally in the shape of a T-square head.

6. A ruling blade as set forth in claim 5 wherein said T-square head has a straight inside edge disposed normal to the ruling blade edge and has a plurality of pin-receiving holes at spaced intervals along said T-square head on each side of the geometric center thereof, said T-square having a central channel sized to slidably receive a ruling blade body.

7. A ruling blade as set forth in claim 3 including a recess in one side of said body at each ruling edge, said recesses being of different depths.

8. A ruling blade as set forth in claim 3 including a beveled surface in one side extending to one ruling edge to form a relatively thin ruling edge, the recess adjacent the beveled surface having less depth than that at the opposite ruling edge.

9. A ruling blade as set forth in claim 3 wherein there is a groove in each side of said body extending the full length of the blade, said grooves being centered in the blade body.

10. A ruling blade comprising a thin, flat, elongated body having a pair of oppositely disposed flat sides, a pair of oppositely disposed parallel ruling edges extending along the body and a pair of oppositely disposed end edges at the ends of the body, a lateral recess at one of said ruling edges extending inwardly therefrom to position the adjacent ruling edge above a supporting surface, and a reference head made integral with said blade body extending laterally beyond said one ruling edge, said reference head being in the form of a generally rectangular shoulder inset from one of said end edges and having a pin-receiving slot at each end and an elongated pin-receiving intermediate slot, said slots being arranged to position a reference surface of a pivot pin in one of said slots in line with said one ruling edge of the blade body.

11. In a drafting system for drawing perspective views and the like, the combination comprising:

a drawing board surface having a drawing sheet superposed thereon, a horizon line and a vanishing point on the horizon line;

a pivot pin secured upright at the first vanishing point;

a thin, flat, elongated ruling blade body having a pair of oppositely disposed flat sides, a pair of oppositely disposed parallel ruling edges extending along the body and a pair of oppositely disposed end edges at the ends of said body, a center groove in at least one of said sides, and a removable reference head detachably mounted on said blade body, said reference head having a top portion and a pair of depending side portions forming a channel sized to receive said body, the side portions having inside guide faces for guiding movement of said reference head along said ruling edges of the blade body, one of said side portions extending laterally beyond one of said ruling edges and having at least one pin-receiving hole arranged to position said blade body on a drawing board surface, said reference head having locking means releasably locking said head to said body including a shaft having an eccentric cam disposed within said center groove, said cam being positioned to move against either of a pair of inside faces forming the sides of said center groove to wedge a ruling edge against the adjacent guide faces of said reference head.

12. In a drafting system for drawing perspective views and the like, the combination comprising:

a drawing board surface having a drawing sheet superposed thereon, a horizon line, a first and second vanishing point on the horizon line;

a first pivot pin secured upright at the first vanishing point;

a second pivot pin secured upright at the second vanishing point;

a first ruling blade having a thin, flat, elongated body with a pair of oppositely disposed flat sides, a pair of oppositely disposed parallel ruling edges extending along the body and a pair of oppositely disposed end edges, a center groove in at least one of said sides;

a removable reference head detachably mounted on said blade body, said reference head having a top portion and a pair of depending side portions forming a channel sized to receive said body, the side portions having inside guide faces for guiding movement of said reference head along said ruling edges of said blade body, one of said side portions extending laterally beyond one of said ruling edges and having at least one pin-receiving hole in line with said one ruling edge whereby said first ruling blade is edge-pivoted about one of said first and second vanishing points for drawing a perspective line up to one of said vanishing points; and a second ruling blade having a laterally projecting head portion with a pin-receiving slot in line with a ruling edge receiving said second pivot pin at the other of said first and second vanishing points.

13. In a drafting system for drawing perspective views and the like, the combination comprising:

a drawing board surface having a drawing sheet superposed thereon, a horizon line, a first and second vanishing point on the horizon line;

a first pivot pin secured upright at the first vanishing point;

a second pivot pin secured upright at the second vanishing point;

a ruling blade having a pair of oppositely disposed flat sides, a pair of oppositely disposed parallel ruling edges extending along the body and a pair of oppositely disposed end edges, a center groove in at least one of said sides providing a pair of inside wall surfaces;

a pair of removable reference heads, each reference head shaped in the form of a T-square head releasably attached at opposite positions on the ruling blade, each of said T-square heads having a locking cam selectively engageable with one of the inside wall surfaces of the blade and each having a plurality of pin-receiving holes at spaced intervals therealong, one of the pin-receiving holes of one of said T-square heads receiving the first pivot pin and one of the pin-receiving holes of said other T-square head receiving the second pivot pin to support the blade in a horizontal position parallel to the horizon line for use in drawing horizontal and vertical lines referenced to said vanishing points.

* * * * *